United States Patent [19]

Cohen

[11] 4,148,441

[45] Apr. 10, 1979

[54] FABRIC PACKAGE, FABRIC PACKAGE CORE, AND FABRIC PACKAGING METHOD

[75] Inventor: Herbert Cohen, Anderson, S.C.

[73] Assignee: Jamaica Consultants, Inc., Jamaica, N.Y.

[21] Appl. No.: 848,744

[22] Filed: Nov. 4, 1977

[51] Int. Cl.[2] ..... B65H 75/10

[52] U.S. Cl. ..... 242/1; 66/150; 139/305; 206/389; 242/55; 242/67.1 R; 242/68.5; 242/222

[58] Field of Search ..... 242/222, 68.5, 68.6, 242/61, 62, 55, 1, 118.8, 68, 67.1 R, 67.3 R; 211/44–48, 113, 124; 248/215; 223/87; 139/305; 66/150; 206/389, 49, 44 R

[56] References Cited

U.S. PATENT DOCUMENTS

| | | | |
|---|---|---|---|
| 1,772,958 | 8/1930 | Moore | 139/305 X |
| 2,486,179 | 10/1949 | Kuehnel | 66/150 |

FOREIGN PATENT DOCUMENTS

| | | | |
|---|---|---|---|
| 958354 | 5/1964 | United Kingdom | 242/61 |

*Primary Examiner*—George E. Mautz

*Attorney, Agent, or Firm*—Steinberg & Blake

[57] ABSTRACT

In order to form a package which includes a length of fabric which at one side edge region is substantially longer than at its other side edge region, the fabric is wound so as to form a wound body of fabric surrounding a given axis, and along the latter axis there is situated a core which has opposed free end regions which respectively have transversely with respect to said axis maximum dimensions one of which is substantially greater than the other. The core end region which is of the greater maximum dimension supports the fabric at its longer side edge region. The core preferably includes tubular and finned core portions, the latter having fins which project from the axis of the core, and the finned core portion extends partly into the tubular core portion.

17 Claims, 8 Drawing Figures

FABRIC PACKAGE, FABRIC PACKAGE CORE, AND FABRIC PACKAGING METHOD

BACKGROUND OF THE INVENTION

The present invention relates to fabric packages as well as to fabric packaging methods and to a core for a fabric package.

It is at the present time well known to provide fabric packages wherein a length of fabric is wound around a core which supports the length of fabric. Such conventional fabric packages present no particular problem as long as the fabric is of the same length as its opposed side edge regions. However, particular problems are encountered when attempting to provide packages of the above general type for a length of fabric which at one side edge region is substantially longer than at its opposed side edge region.

Thus, for certain uses fabrics are manufactured in such a way that they are gathered along one side edge region, so as to be elastically stretchable at this gathered side edge region, for example. Thus, such fabrics will have at the gathered side edge region a length which is substantially less than the length of the fabric at the opposed, non-gathered side edge region thereof. Experience has shown that it is not possible to provide packages of the above general type when dealing with a fabric which is shorter at one side edge region than the other.

SUMMARY OF THE INVENTION

It is accordingly a primary object of the present invention to provide for a fabric of the above type a fabric package in which the fabric is properly wound even though it has at its opposed side edge regions substantially different lengths, respectively.

It is furthermore an object of the present invention to provide a method for manufacturing such a package.

In addition, it is an object of the present invention to provide cores suitable for use in such packages.

According to the invention a fabric which is substantially longer at one side edge region than the other is wound around a predetermined axis to form a body of wound fabric which surrounds the latter axis. A core is situated along this axis and surrounded by the wound body of fabric so as to support the latter. This core has opposed ends which in a direction transverse to the above axis have, respectively, maximum dimensions one of which is greater than the other. Thus the end of the core which has the greater maximum dimension supports the fabric at its longer side edge region, while the end of the core which is of the smaller maximum dimension supports the fabric at its shorter side edge region. When the fabric is wound, it is simultaneously situated on at least a part of the above core. This core includes a tubular core portion and a finned core portion, the latter finned core portion extending partly into the tubular core portion.

BRIEF DESCRIPTION OF DRAWINGS

The invention is illustrated by way of example in the accompanying drawings which form part of this application and in which.

DESCRIPTION OF PREFERRED EMBODIMENTS

Figure 3:
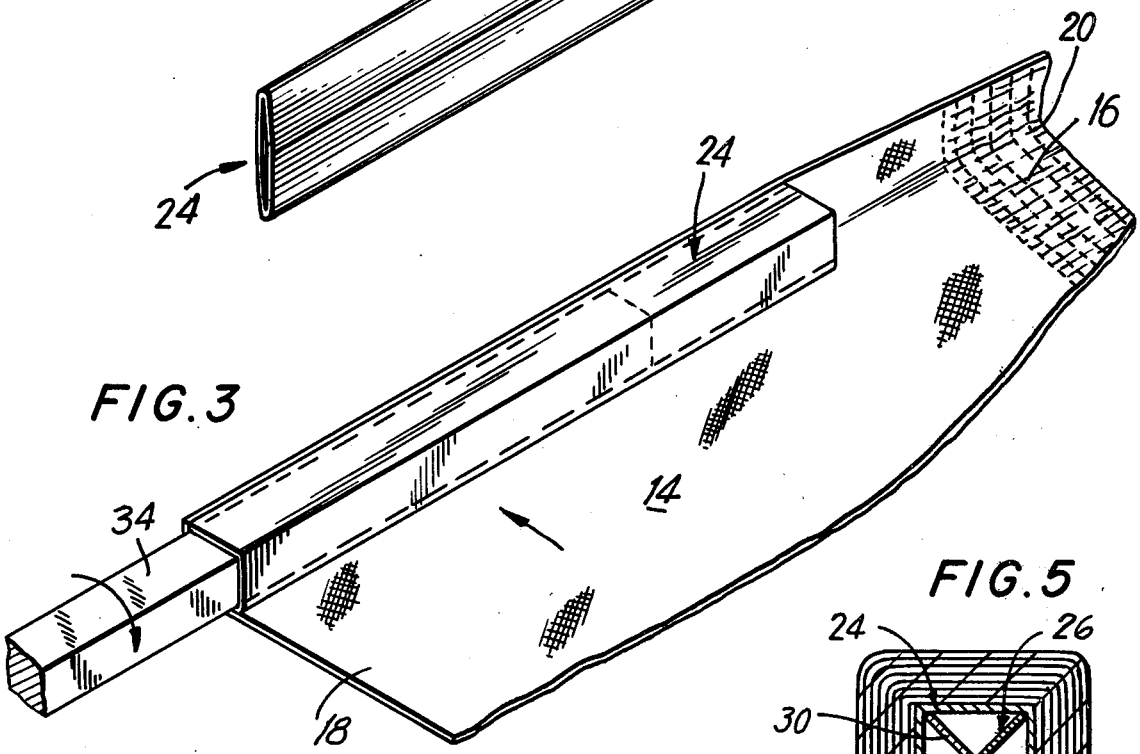
FIG. 3 illustrates part of a method of the invention according to which a fabric which is longer at one side edge region than the other is wound onto the tubular core portion of FIG. 2.
Figure 5:
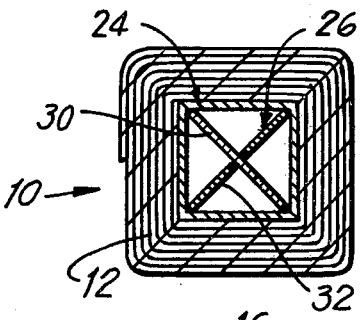
FIG. 5 is a transverse section of the package of FIG. 4 taken along line 5—5 of FIG. 4 in a direction of the arrow.
Figure 4:
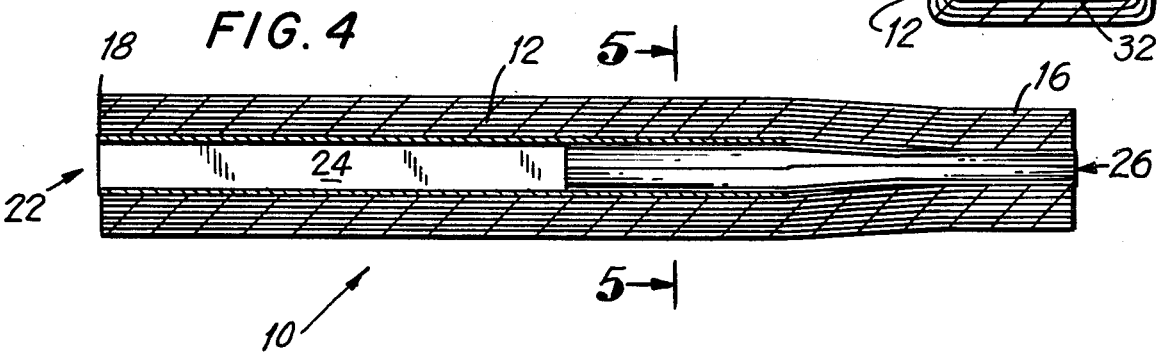
FIG. 4 shows in an axial sectional elevation a finished fabric package of the invention which includes a core made up of the components illustrated in FIGS. 1 and 2.

Referring first to FIGS. 4 and 5, there is illustrated therein one possible embodiment of a fabric package 10 according to the present invention. This package 10 includes a body 12 of wound fabric, the wound body of fabric 12 surrounding a given axis. As further explained below, the body of wound fabric 12 is formed from the length of the fabric 14 which is fragmentarily illustrated in FIG. 3. This fabric 14 can be any desired flexible cloth, for example. The fabric 14 has a side edge region 16 which is substantially shorter than its opposed side edge region 18. Thus the fabric 14 can in a known way be gathered longitudinally of its side edge region 16 with the gathered fabric being stitched to longitudinally extending elastic threads 20, so that when these threads 20 are substantially unstretched, the side edge region 16 of the fabric is substantially shorter than the opposed side edge region 18. Such fabric can be used, for example, to make skirts which have gathered, stretchable waist regions formed by the side edge region 16.

Figure 2:
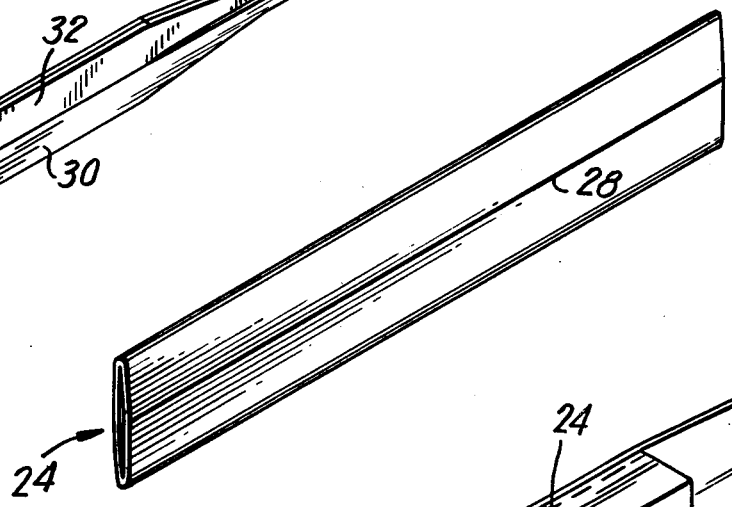
FIG. 2 shows a tubular core portion of the invention, this tubular core portion also being shown in a perspective view in a flattened condition.

As illustrated in FIGS. 4 and 5, the wound body of fabric 12 is supported by a core 22 which includes an elongated tubular portion 24 and an elongated finned portion 26. As may be seen from FIG. 2, the tubular core portion 24 is made from a sheet of cardboard or the like which initially is of a rectangular configuration. This sheet is scored along lines 28 and side edges of the sheet are joined together in any suitable way so that the sheet forms the tubular core portion 24 which can assume the flattened condition shown in FIG. 2 or the open condition shown in FIGS. 4 and 5. It will be seen that between the score lines 28 the sheet which forms the tubular core portion 24 has equal widths, so that in the illustrated example the core portion 24 in its open condition of use, shown in FIGS. 4 and 5, has the cross section of a polygon which in the particular example of FIGS. 4 and 5 is a square.

Figure 1:
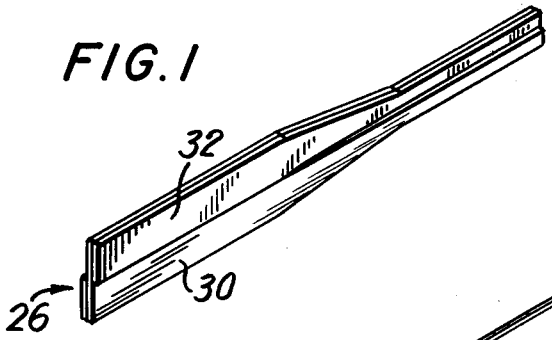
FIG. 1 illustrates in a perspective view a finned core portion of the invention, shown in FIG. 1 in a flattened condition.

The finned portion 26 is made of a pair of flat sheets 30 and 32 also of cardboard, for example. The cardboard sheet material of the core portions may be relatively thick and may include one or more corrugated layers so as to have the required stiffness. It will be seen that each of the sheets 30 and 32 has an elongated relatively wide portion and an elongated relatively narrow portion, with a tapered transition portion being situated between the elongated wide and narrow portions of each sheet 30 and 32. The sheet 30 is formed with a central slot extending along its axis from its narrow end, while the sheet 32 is formed with a slot or slit extending axially therealong from its wide end. These slits terminate substantially midway between the ends of each sheet 30 and 32, and these sheets are interlocked at their slits in the manner illustrated in FIG. 1. Thus the inner ends of the slits of the sheets 30 and 32 engage each other. In this way it is possible also for the finned core portion 26 to assume the flattened condition shown in FIG. 1. However, it is also possible to turn the sheets 30 and 32 one with respect to the other so that they are in mutually perpendicular planes with the sheets forming fins which project substantially radially from the common axis of the sheets 30 and 32. In this latter condition the finned core portion 26 is slipped into the tubular core portion 24. The width of the elongated wider portions of the sheets 30 and 32 is equal to the diagonal of the square cross section of the tubular core portion 24 as is apparent particularly from FIG. 5. Thus, the elongated edges of the wider portions of the sheets 30 and 32 will respectively extend along the corners of the tubular core portion 24 with the latter serving to maintain the finned portion 26 in its open condition shown in FIGS. 4 and 5 while the finned portion 26 also cooperates with the tubular portion 24 to maintain the latter in its open condition shown in FIGS. 4 and 5.

As is indicated in FIG. 3, in accordance with the method of the invention, the fabric 14 is wound onto the tubular core portion 24 before the finned core portion 26 is assembled therewith. For this purpose the tubular core portion 24 is slipped onto a rotary shaft 34 which is driven by any suitable motor and transmission in the direction of the arrow shown in FIG. 3. The dimension of the shaft 34 is such that it will be slidably received in the tubular core portion 24 in the manner illustrated in FIG. 3. The leading end of the fabric 14 is joined in any suitable way to the exterior surface of the tubular core portion 24, and the shaft 34 is then driven with the fabric 14 being fed to the rotating core portion 24 so as to be wound thereon in the manner illustrated in FIG. 3. It will be noted that with the embodiment of the method of the invention shown in FIG. 3, the shaft 34 is horizontal so that the tubular core portion 24 has a horizontal axis about which it is turned and about which the fabric 14 is wound so as to form in this way on the tubular core portion 24 a wound body of fabric which extends freely beyond the tubular core portion 24 and terminates beyond the latter at the shorter side edge region 16 of the fabric. The width of the fabric 14 may be any conventional width such as a width of 42 inches, although wider or narrower fabrics can be wound if desired. Once a given length of fabric is wound onto the tubular core portion 24, the winding step is terminated. For example 10 yards of the fabric 14 may be wound in this manner onto the tubular core portion 24.

Then the tubular core portion 24 with the fabric wound thereon is removed from the shaft 34, and the finned core portion 26 is slipped axially into the tubular core portion 24 with the narrow end of the finned core portion 26 being first introduced into the open left end of the tubular core portion 24, as viewed in FIG. 4. The finned core portion 26 is then axially shifted with respect to the tubular core portion 24 until the finned core portion 26 assumes the position illustrated in FIG. 4. For this purpose, if necessary, a suitable bar may be introduced subsequent to the finned core portion 26 into the tubular core portion 24 to engage the trailing end of the finned core portion 26 and continue to push the latter to the position illustrated in FIG. 4.

In this way, the package illustrated in FIG. 4 is completed.

It will be noted from FIG. 4 that the core 22 has opposed end regions one of which has in a direction transverse to the common axis of the core portions 24 and 26 a maximum dimension greater than the other. Thus the maximum dimension of the core portion 24 is formed by a diagonal thereof which of course is greater than the width of the narrow end of one of the sheets 30 or 32, this latter width being the maximum dimension of the end region of the core portion 26 which is distant from the opposed end region of the core portion 24. The relationship between these maximum dimensions at the opposed free end regions of the core portions 24 and 26 is such that the shorter side edge region 16 will be smoothly wound onto the narrow end of the core portion 26 while the longer side edge region 18 of the fabric will be smoothly wound onto the core portion 24.

At the region of the gathered shorter side edge region 16, the fabric has at the inner edge of the gathered region a number of pleats which gradually widen out until the fabric assumes a length equal to the length of the fabric at its longer side edge region 18. At this transition region the fabric is supported by the tapered intermediate portions of the sheets 30 and 32, and the dimensions of this tapered portion are such that the fabric will also be smoothly wound at this transition region thereof, in the manner apparent from FIGS. 4 and 5. Thus, the length of the core portion 24 is such that it corresponds to the width of the longer portion of the fabric where this width remains constant. The length of the narrower part of the core portion 26 corresponds to the width of the gathered shorter side edge region 16. The length of the tapered portion of each sheet 30 and 32 corresponds to the transition region from the shorter side edge region 16 to the part of the fabric where its length remains constant at the longer length of the side edge region 18.

Thus, it will be seen that with the above method of the invention it is possible to provide a package of the invention in which the fabric is smoothly wound even though it has one side edge region which is substantially shorter than the opposed side edge region. At the same time, the core portions 24 and 26 can easily be disassembled from each other and flattened so that large numbers thereof can be shipped in a minimum space.

Moreover, it will be seen that the core 22 of the invention is manufactured from simple inexpensive sheet material so that expensive molding procedures utilized in manufacturing conventional tapered cores which include chip board are not required.

Furthermore, it will be seen that with the particular embodiment of the invention shown in FIGS. 1-5, the gathered shorter side edge region 16 and the transition region of the fabric are supported between the exterior side edges of the sheets 30 and 32 so that between these side edges the fabric windings can hang freely, thus achieving in this way an exceedingly effective support for the gathered shorter side edge region 16 and the transition region of the fabric, contributing to the smoothness with which the fabric is wound to form the package 10 of FIGS. 4 and 5.

The fabric can be wound in a manner shown in FIG. 3 in any suitable fabric-winding machine which need only be equipped with the shaft 34 which is capable of accommodating the core portion 24. On such a machine a selected length of the fabric, such as 10 yards thereof, for example, can be fed in a conventional manner by suitable feed rolls or the like to the rotating core portion 24. The leading end of the fabric is attached in any suitable way to the core portion 24 as by utilizing for this purpose a suitable adhesive tape, and in the same way the trailing end of the fabric at the outer winding thereof can be attached to the remainder of the body of the fabric to provide the package shown in FIGS. 4 and 5.

Figure 6:
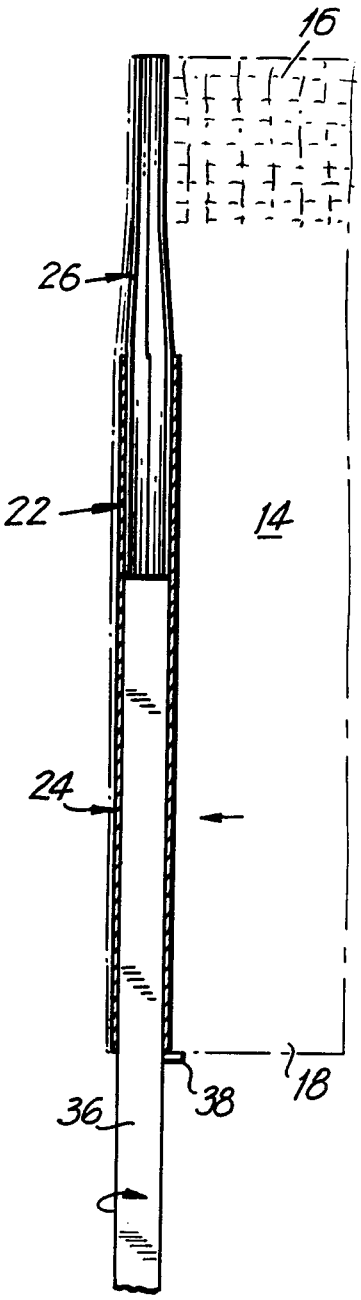
FIG. 6 is a schematic sectional elevation showing a different embodiment of a method of the invention for achieving a package as illustrated in FIGS. 4 and 5.

Although in the above-described embodiment of FIGS. 1–5 the fabric is wound around a horizontal axis on only a part of the core means 22, these latter features are not essential. Thus, FIG. 6 shows an embodiment of the invention where the fabric is wound about a vertical axis with the core 22 being fully assembled during the winding of the fabric. Thus, referring to FIG. 6 it will be seen that in this embodiment the core 22 is driven by way of an upright shaft 36 which may have a vertical axis and which of course has a square cross section corresponding to the interior of the core portion 24. With this embodiment the core portion 24 is slipped onto the upper portion of the shaft 36 until the lower edge of the tubular core portion 24 reaches the stop pin 38. The shaft 36 is driven by any suitable motor and transmission of the winding machine. The finned core portion 26 extends into the tubular core portion 24 and has its lower end engaging the top end of the shaft 36.

The fabric 14 in this case is fed in a substantially vertical plane toward the rotating core 22. Any suitable feed rolls which have vertical axes of rotation are used for this purpose. Also it will be noted that the fabric is fed with its shorter gathered side edge region 16 at the uppermost part of the fabric so that the wider side edge region 18 becomes wound around the core portion 24 which is situated at an elevation lower than the finned core portion 26.

Thus, with the method of FIG. 6 it is also possible to achieve a fabric package as illustrated in FIGS. 4 and 5.

Figure 7:
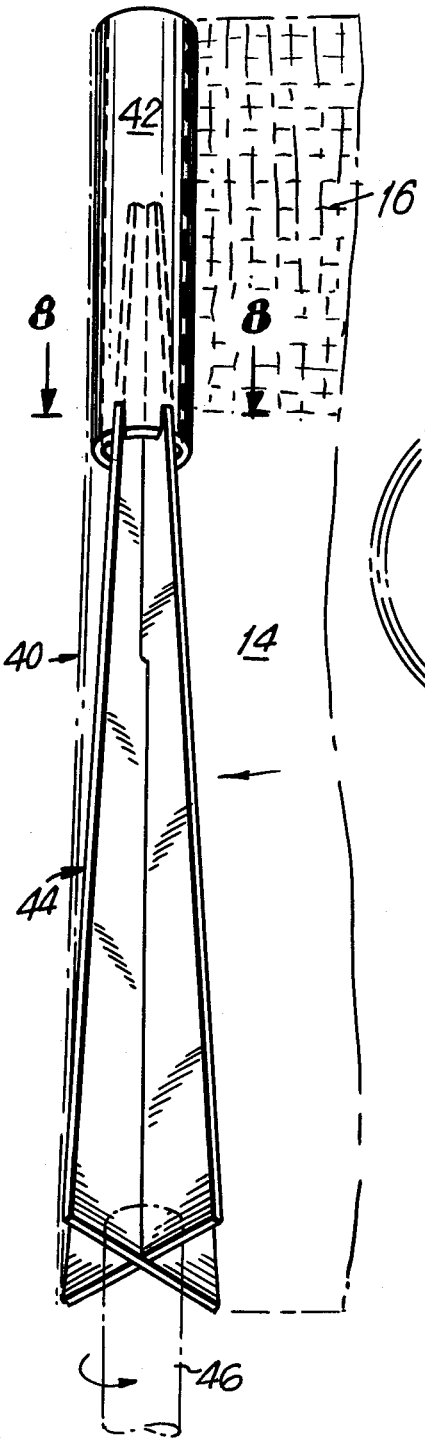
FIG. 7 is a perspective illustration of another embodiment of a core of the invention with FIG. 7 also illustrating how the core is supported during winding of fabric onto the same.

While in the embodiments described above the tubular core portion serves to support the fabric at its longer side edge region, while the finned core portion supports the fabric at its shorter side edge region, these features also are not essential. Thus, referring to FIGS. 7 and 8 it will be seen that there is illustrated therein a core means 40 having a tubular core portion 42 and a finned core portion 44. The tubular core portion 42 is in the form of a relatively stiff cylinder of cardboard, for example, having a hollow interior and opposed open ends. This tubular core portion 42 may be circular in cross section, as is apparent from FIG. 8. Moreover, this tubular core portion 42 has at its upper free end, as viewed in FIG. 7, a maximum transverse dimension which is smaller than the maximum transverse dimension of the lower free end of the finned core portion 44. This finned core portion 44 may have a construction identical with the finned core portion 26 except that the finned core portion 44 is longer than the finned core portion 26 and has a gradual uninterrupted taper all the way from its larger end to its smaller end. The finned core portion 44 extends at its smaller end region into the hollow interior of the tubular core portion 42 through the lower end of the latter, as viewed in FIG. 7. The sheets which form the fins of the finned core portion 44 are interlocked with each other in the same way as the sheets 30 and 32 so that these sheets can also be folded into a flat condition. However during use the sheets are normal to each other as illustrated. The tubular core portion 42 is formed at its lower end region with axially extending notches extending from the lower end of the tubular core portion 42 toward the upper end thereof, through a relatively short distance, as illustrated in FIG. 7. The width of these notches corresponds to the thickness of the sheets which form the finned core portion 44, so that these sheets extend into the notches which are spaced from each other by 90° about the common axis of the core portions 42 and 44. These notches at the lower end of the tubular core portion 42 thus serve to maintain the sheets which form the finned core portion 44 in their mutually perpendicular condition where the fins formed by these sheets extend radially from the common axis of the core portions 42 and 44.

In order to wind the fabric 14 onto the core 40, this latter core is also situated in an upright vertical position with its larger end situated below its smaller end. Thus for this purpose the larger end of the core 40 is mounted on the upper end of a rotary vertical drive shaft 46 which is fragmentarily illustrated in phantom lines in FIG. 7. This drive shaft 46 may be operated in the same way as the drive shaft 36. The drive shaft 46 has at its top end a pair of mutually perpendicular slits which extend downwardly into the shaft 46 from its top end through a distance sufficient to receive the mutually perpendicular fins of the finned core portion 44 while at the same time reliably supporting the entire core in an upright condition and being capable of transmitting a rotary drive thereto. These slits of course extend diametrically across the shaft 46 and have opposed open ends along the opposite side surfaces of the shaft 46.

The fabric 14 is fed to the core 40 and wound thereon in the same way that the fabric 14 is fed to and wound on the core 22 in FIG. 6. Of course in both cases when the winding of the fabric is completed, the core with the fabric thereon can easily be removed from the drive shaft simply by being displaced upwardly with respect thereto.

Figure 8:
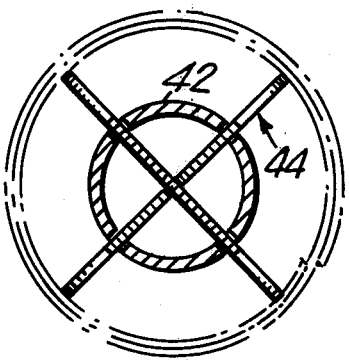
FIG. 8 is a transverse section of the core of FIG. 7, taken along 8—8 of FIG. 7 in the direction of the arrows and showing in phantom lines fabric which is wound onto the core of FIG. 7.

FIG. 8 shows in phantom lines the fabric wound around the sectionally illustrated core structure.

With the embodiment of FIGS. 7 and 8, although the tubular core portion 42 cannot be flattened, nevertheless it has a relatively small diameter so that it does not occupy an undesirably great space. Of course the finned core portion 44 can be flattened in the same way as the finned core portion 26. Thus the core of FIGS. 7 and 8 also can be inexpensively manufactured and shipped while occupying a relatively small space.

The length of the tubular core portion 42 of course corresponds to the width of the gathered shorter side edge region 16. From the core portion 42 the non-gathered portion of the fabric will be supported by the fins which gradually increase in width in the manner illustrated. Thus the transition region from the gathered to the non-gathered portion of the fabric is readily accommodated and the turns of the fabric will in this case be supported beyond the shorter side edge region on the edges of the fins so that the fabric can be freely suspended between the side edges of the fins to provide in this way a highly effective core support for the body of wound fabric.

What is claimed is:

1. In a method for manufacturing a package which includes a length of fabric having opposed side edge regions one of which is substantially longer than the other which is wound around a core having first and second telescoping portions aligned along their longitudinal axes and which are axially shiftable with respect to each other, said first core portion having a given maximum dimension transverse to its axis and said second core portion having a given maximum dimension transverse to its axis substantially smaller than said maximum dimension of said first core portion, the steps of winding the fabric initially on said first core portion while said second core portion is in a position where it does not extend from said first core portion to form therefrom a body of wound fabric surrounding said first core portion, such that the longer side edge region of said fabric is wound on said first core portion and the shorter side edge region of the fabric extends axially beyond said first core portion, and then axially shifting said second core portion with respect to said first core portion to a location where said maximum dimension of said second core portion is situated at the shorter edge region of the fabric.

2. In a method as recited in claim 1 and wherein the step of winding the fabric onto said first core portion takes place while said axis is substantially horizontal.

3. A core for supporting a wound body of fabric which has opposed side edge regions one of which is substantially longer than the other, comprising an elongated tubular core portion having a given central axis and an elongated finned core portion also having an elongated central axis and including a plurality of fins projecting from the latter axis, said finned core portion extending in part into said tubular core portion while engaging and being supported by said tubular core portion, with said central axes of both core portions coinciding, and with each core portion having a free end region distant from the other core portion, said free end regions respectively having transverse to said coinciding central axes maximum dimensions one of which is substantially greater than the other, so that the fabric can be wound onto said core portions with the longer side edge region of the fabric situated at that end region which has the greater maximum dimension.

4. The combination of claim 3 and wherein the fins of said finned core portion are at least in part of a tapered configuration.

5. The combination of claim 4 and wherein said finned core portion includes a pair of sheet members having opposed ends one of which is narrower than the other, and said sheet members being axially slotted along part of their length with the slot of one of said members extending from the narrow end thereof while the slot of the other said members extends from the wider end thereof, and said sheet members being interlocked at the slotted portions thereof for providing for said finned portion of said core fins which project from said central axis thereof, so that said finned portion can be folded to a flat condition when not in use while capable of being turned at said sheet members thereof to a position of use where said sheet members are substantially normal to each other.

6. The combination of claim 4 and wherein said tubular core portion is in the form of a tube of flexible sheet material which can be flattened when in a condition of non-use and which can be opened to a position of use where said tubular core portion has the cross section of a polygon.

7. The combination of claim 6 and wherein said polygon is a square.

8. The combination of claim 7 and wherein said finned core portion includes a pair of mutually perpendicular sheet members extending perpendicularly across each other and having at said fins side edge portions which slidably engage said tubular core portion in the interior thereof along corners of said tubular portion.

9. The combination of claim 8 and wherein said finned core portion is axially shiftable along the interior of said tubular core portion.

10. The combination of claim 9 and wherein said finned core portion is shiftable when in use to a position extending in part outwardly beyond said tubular core portion and said finned core portion having beyond said tubular core portion said end region whose maximum dimension is smaller than the maximum dimension of said tubular core portion.

11. The combination of claim 4 and wherein said tubular core portion is of a circular cross section and has at its end region the smaller of said maximum dimensions.

12. The combination of claim 11 and wherein said finned core portion has fins which taper from said end region thereof which has the greater of said maximum dimensions, said fin core portion extending partly into said tubular core portion.

13. The combination of claim 12 and wherein said tubular core portion has at its end which receives said finned core portion slots into which fins of said finned core portion extend.

14. A fabric package comprising a body of fabric wound around a predetermined axis, said fabric having opposed side edge regions one of which is substantially longer than the other, and a core situated along said axis and surrounded by the body of wound fabric to support the same, said core including a tubular core portion and a finned core portion extending partly into said tubular core portion while extending axially beyond the latter, said core portions respectively terminating in free end regions which respectively support the wound fabric at said opposed side edge regions thereof, said free end regions of said core portions respectively having transverse to said axis maximum dimensions one of which is substantially greater than the other, and the core portion with said greater maximum dimension supporting the fabric at its longer side edge region while the core portion with the smaller of said maximum dimensions supports the fabric at the shorter of its side edge regions.

15. The combination of claim 14 and wherein said finned core portion has between said tubular core portion and said free end region of said finned core portion an elongated tapered portion for supporting the fabric at a transition region between said side edge regions.

16. The combination of claim 15 and wherein said finned core portion has at its free end region said smaller maximum dimension.

17. The combination of claim 14 and wherein said tubular core portion has at said free end region said smaller maximum dimension.

* * * * *